US008800175B1

(12) United States Patent
Faraci et al.

(10) Patent No.: US 8,800,175 B1
(45) Date of Patent: Aug. 12, 2014

(54) ADJUSTABLE SNOW REMOVAL SYSTEM

(76) Inventors: Joseph Faraci, Arlington Heights, IL (US); Frank Faraci, Arlington Heights, IA (US); Peter Masi, Mt. Prospect, IL (US)

( * ) Notice: Subject to any disclaimer, the term of this patent is extended or adjusted under 35 U.S.C. 154(b) by 52 days.

(21) Appl. No.: 13/542,949

(22) Filed: Jul. 6, 2012

(51) Int. Cl.
*E01H 5/06* (2006.01)
*E01H 5/02* (2006.01)

(52) U.S. Cl.
USPC ..... 37/273; 37/285; 294/54.5

(58) Field of Classification Search
USPC ..... 37/266, 270, 273, 264, 285, 272, 278, 37/284; 294/53.5, 54.5, 176, 178
See application file for complete search history.

(56) References Cited

U.S. PATENT DOCUMENTS 885,309 A * 4/1908 Adams ..... 56/400.19
1,375,505 A * 4/1921 Grady ..... 37/284
1,697,572 A * 1/1929 Perham ..... 172/373
1,956,295 A * 4/1934 Lindgren ..... 37/284
2,388,985 A 11/1945 Martin
2,536,607 A * 1/1951 Jenkins ..... 56/400.17
2,658,804 A * 11/1953 Andrews ..... 403/93
2,724,610 A * 11/1955 Fitzgerald ..... 294/55.5
2,752,840 A * 7/1956 Schrader ..... 172/372
2,767,545 A * 10/1956 Jenkins ..... 56/400.06
2,771,089 A * 11/1956 Magida ..... 135/69
3,773,375 A * 11/1973 Nehls ..... 37/268
3,898,753 A * 8/1975 Kinnunen ..... 37/273
4,103,954 A * 8/1978 Vaslas ..... 294/54.5
4,787,661 A * 11/1988 Rutledge ..... 294/58
4,804,219 A * 2/1989 Berg ..... 294/54.5
4,878,704 A * 11/1989 Jacanin et al. ..... 294/54.5
4,991,324 A * 2/1991 Fine et al. ..... 37/284
5,048,883 A * 9/1991 Waluk ..... 294/54.5
5,133,582 A * 7/1992 Rocha ..... 294/58
5,228,734 A * 7/1993 Pollastro ..... 294/54.5
5,440,828 A * 8/1995 Simpson ..... 37/285
5,440,868 A * 8/1995 Darnell ..... 56/400.17
5,676,412 A * 10/1997 Kahley ..... 294/53.5
5,727,830 A 3/1998 Asher
5,791,072 A 8/1998 Schbot
5,810,408 A * 9/1998 Armstrong ..... 294/57
6,269,558 B1 8/2001 Alexander
6,290,273 B1 * 9/2001 Moisan ..... 294/54.5
7,237,814 B2 * 7/2007 Handzlik ..... 294/54.5
7,299,614 B2 * 11/2007 Sanders ..... 56/400.01
7,856,802 B2 * 12/2010 Thibault et al. ..... 56/400.04
8,166,677 B1 * 5/2012 Woyak ..... 37/265
2002/0088148 A1 7/2002 Kagen
2005/0268498 A1 12/2005 Fortino
2011/0214316 A1 9/2011 Gomez
2011/0258888 A1 10/2011 Swenson

* cited by examiner

*Primary Examiner* — Alicia Torres
*Assistant Examiner* — Joan D Misa

(57) ABSTRACT

An adjustable snow shovel system for facilitating effective removal of accumulated snow has a generally tubular, three-way adjustable shovel frame. The system has a generally tubular, adjustable handle bar horizontally located on the shovel frame. The handle bar is adjustable for facilitating effective removal of accumulated snow. The system has a pivotally adjustable shovel assembly having a first shovel member and a second shovel member. The shovel assembly is generally horizontally located on the shovel frame. The shovel assembly can be affixed into a position having the first shovel member and the second shovel member in-line with one another maximizing a shovel assembly width for facilitating effective removal of accumulated snow. The shovel assembly can be affixed into a position having the first shovel member and the second shovel member located at an angle with respect to one another for facilitating effective removal of accumulated snow.

5 Claims, 7 Drawing Sheets

ADJUSTABLE SNOW REMOVAL SYSTEM

BACKGROUND OF THE INVENTION

Snow shovels have been used for clearing snow accumulation for many years, likely since the advent of a standard shovel. A typical snow shovel is equipped with a generally flat blade constructed from plastic or aluminum with a centrally located handle attached. While generally effective, the snow shovel requires a significant physical effort for use leading to fatigue and sometimes pain for the user. The present invention features an adjustable snow shovel system for facilitating effective removal of accumulated snow.

SUMMARY

The present invention features an adjustable snow shovel system for facilitating effective removal of accumulated snow, wherein said system comprises a generally tubular, three-way adjustable shovel frame. In some embodiments, the shovel frame is adjustable in a plane. In some embodiments, the shovel frame can be affixed into position between 0 and 90 degrees with respect to a generally horizontal ground surface via a first positioning member and a second positioning member.

In some embodiments, the system comprises a generally tubular, adjustable handle bar horizontally located on the shovel frame. In some embodiments, the handle bar is adjustable in a plane. In some embodiments, the handlebar can be affixed into position between 0 and 90 degrees with respect to the generally horizontal ground surface via a third positioning member and a fourth positioning member. In some embodiments, the handle bar is adjustable for facilitating effective removal of accumulated snow.

In some embodiments, the system comprises a pivotally adjustable shovel assembly having a first shovel member and a second shovel member. In some embodiments, the shovel assembly is generally horizontally located on the shovel frame. In some embodiments, the shovel assembly is adjustable in a plane. In some embodiments, the shovel assembly can be affixed into position between 0 and 90 degrees in a plane parallel to the generally horizontal ground surface via a fifth positioning member and a sixth positioning member.

In some embodiments, the shovel assembly can be affixed into a position having the first shovel member and the second shovel member in-line with one another maximizing a shovel assembly width for facilitating effective removal of accumulated snow. In some embodiments, the shovel assembly can be affixed into a position having the first shovel member and the second shovel member located at an angle with respect to one another for facilitating effective removal of accumulated snow.

Any feature or combination of features described herein are included within the scope of the present invention provided that the features included in any such combination are not mutually inconsistent as, will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
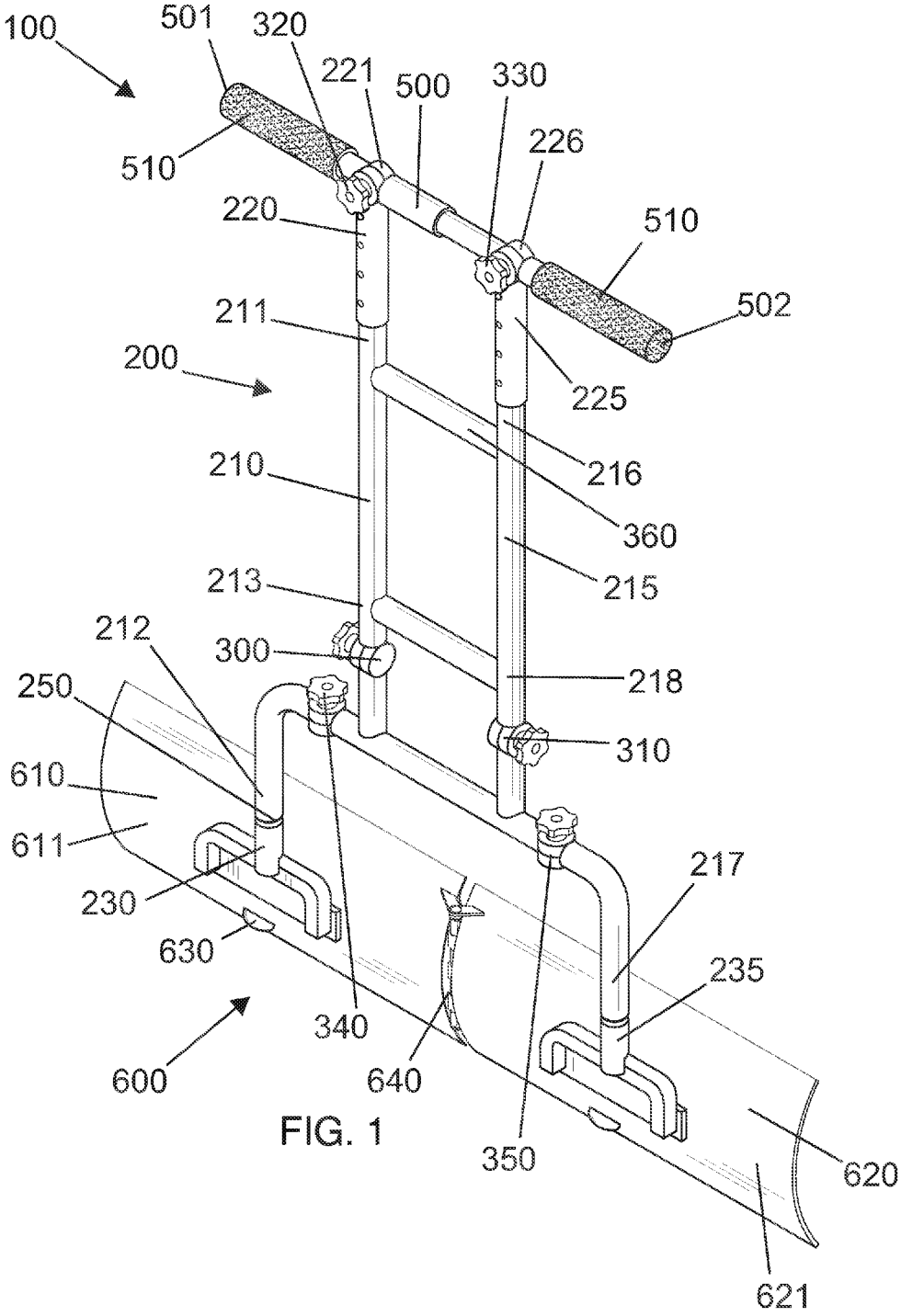
FIG. 1 is a perspective view of the present invention.
Figure 2:
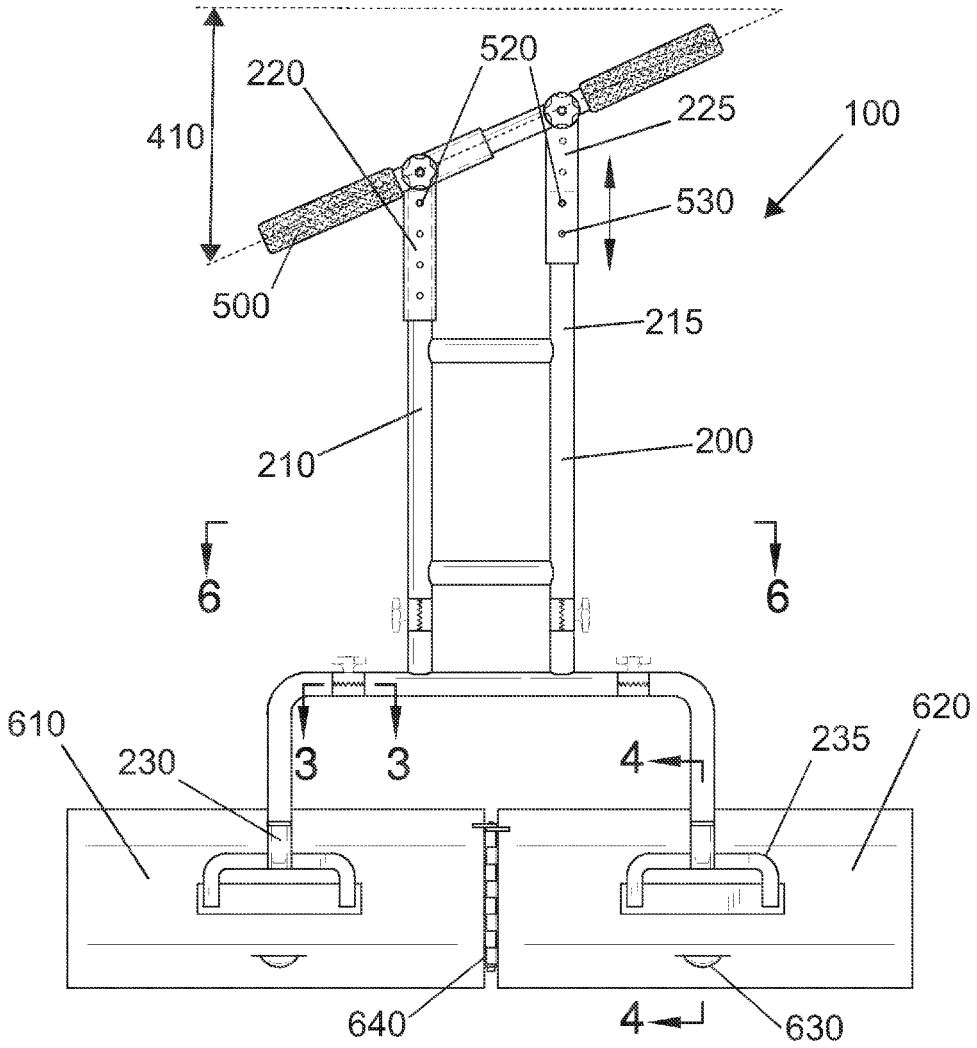
FIG. 2 is a rear view of the present invention.
Figure 3:
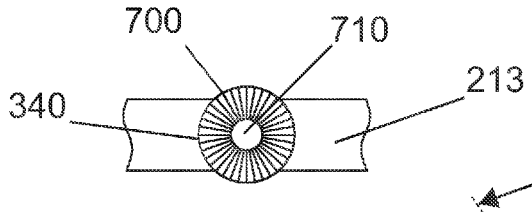
FIG. 3 is a view of the indexing surface of the present invention.
Figure 4:
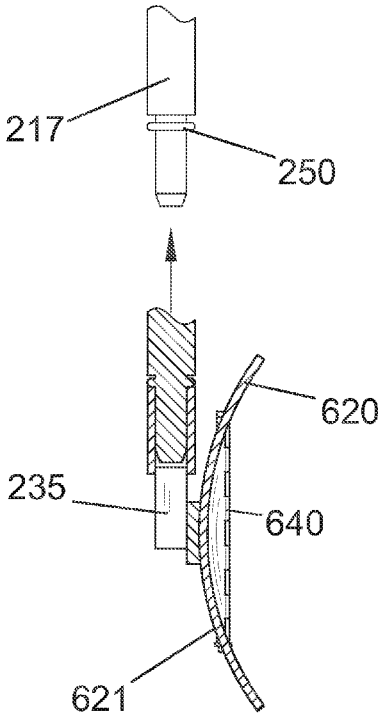
FIG. 4 is a cross-sectional view of the shovel frame second side of the present invention.
Figure 5:
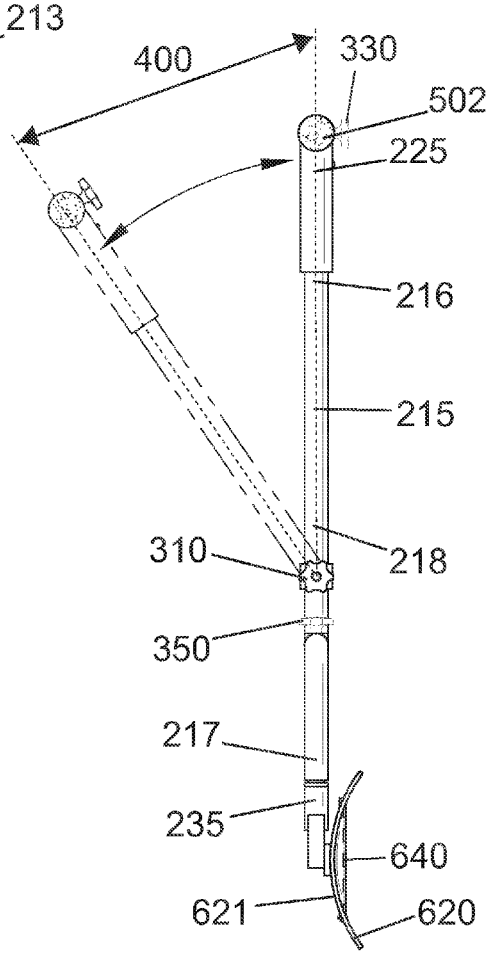
FIG. 5 is a side view of the present invention.
Figure 6:
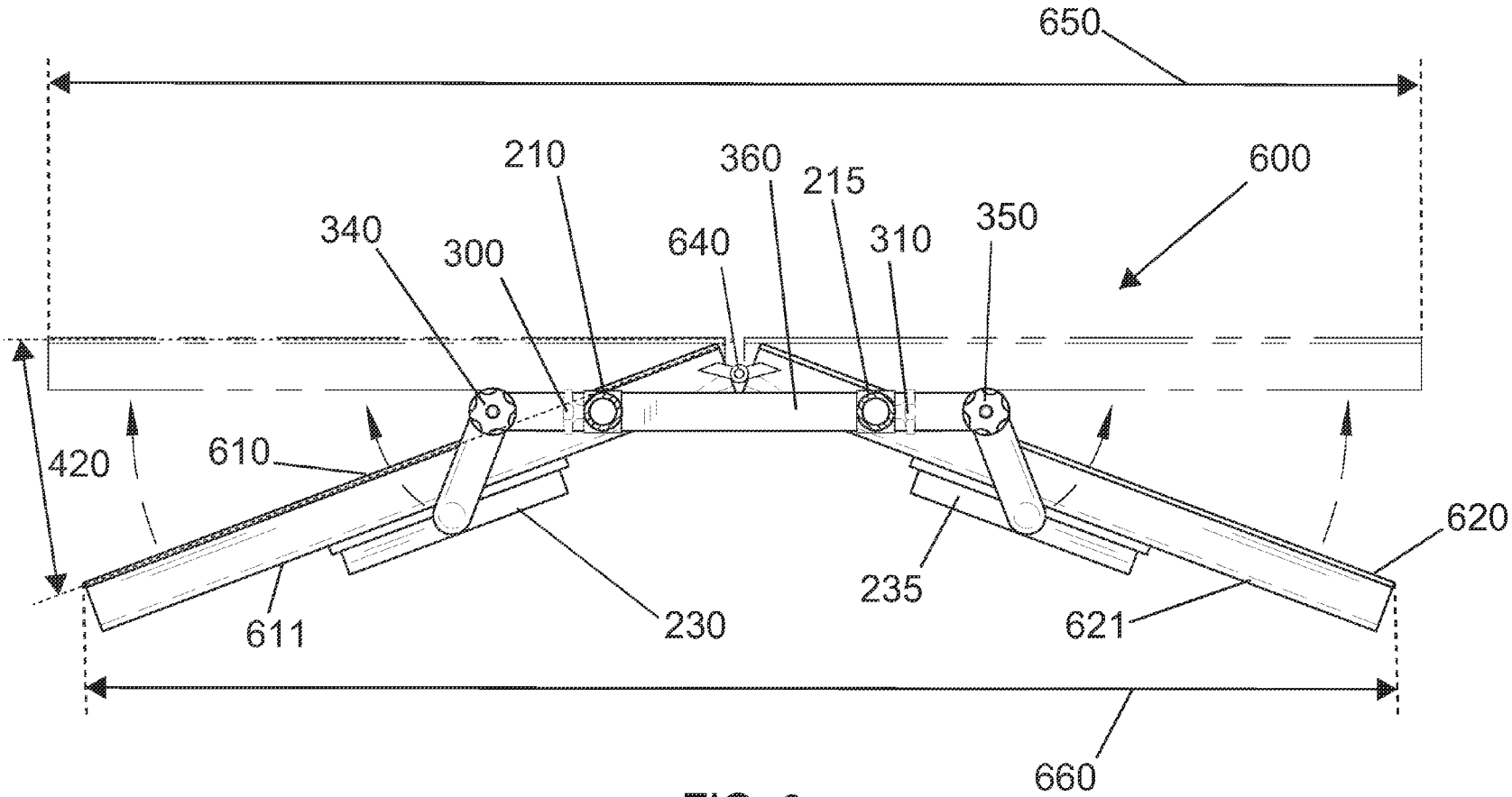
FIG. 6 is a top view of the shovel assembly of the present invention.
Figure 7:
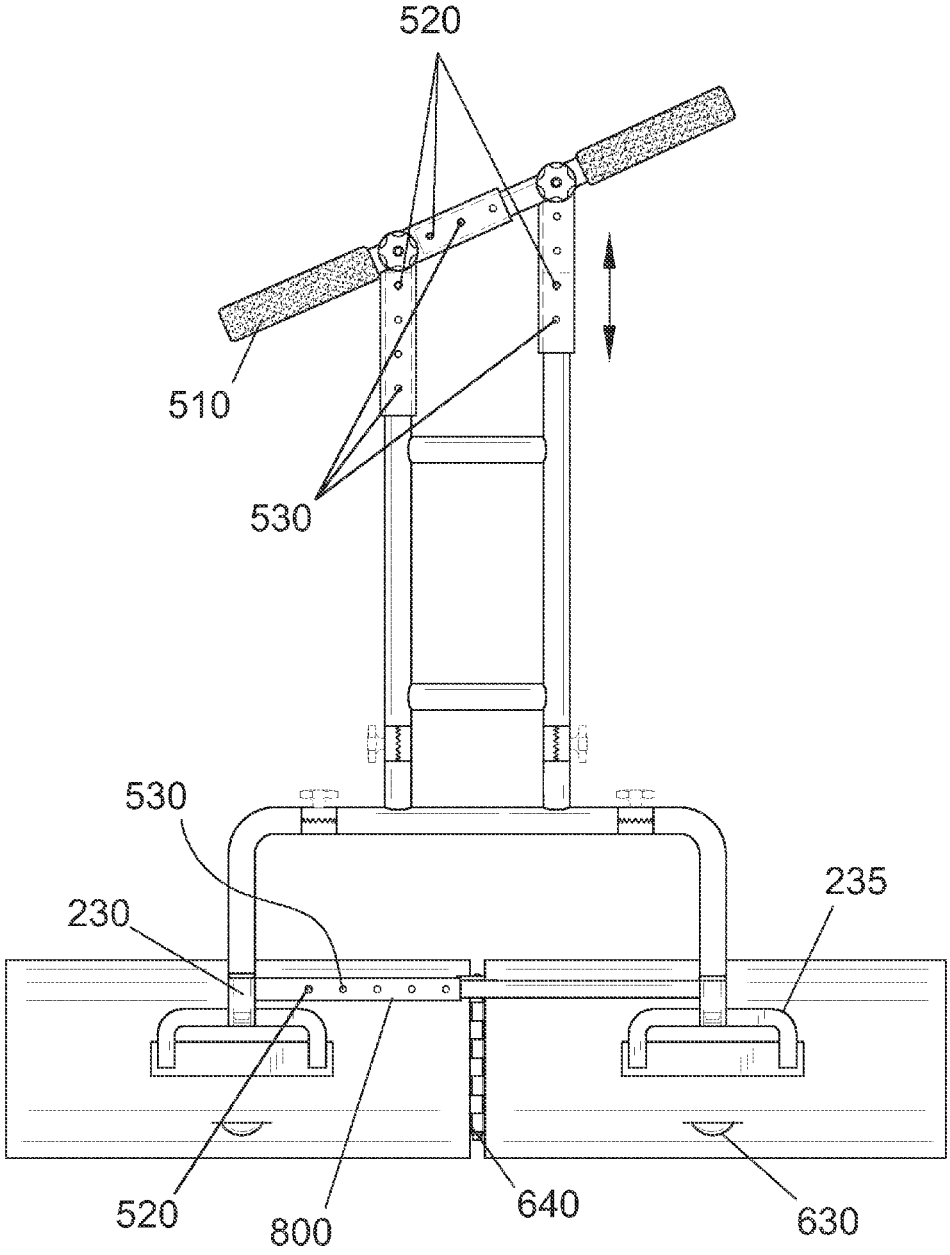
FIG. 7 is a rear view of an alternate embodiment of the present invention.
Figure 8:
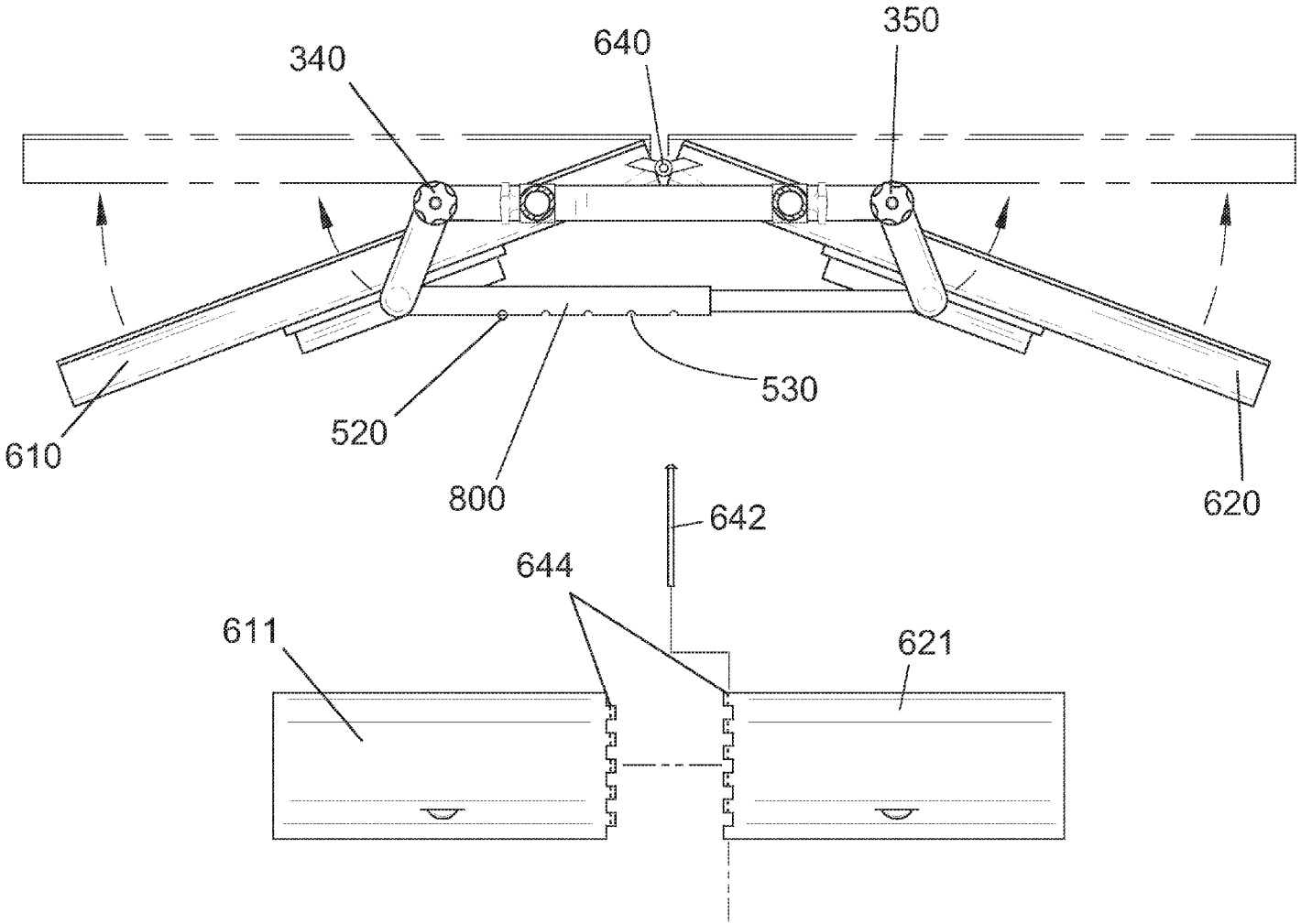
FIG. 8 is a top view of an alternate embodiment of the shovel assembly of the present invention.
Figure 9:
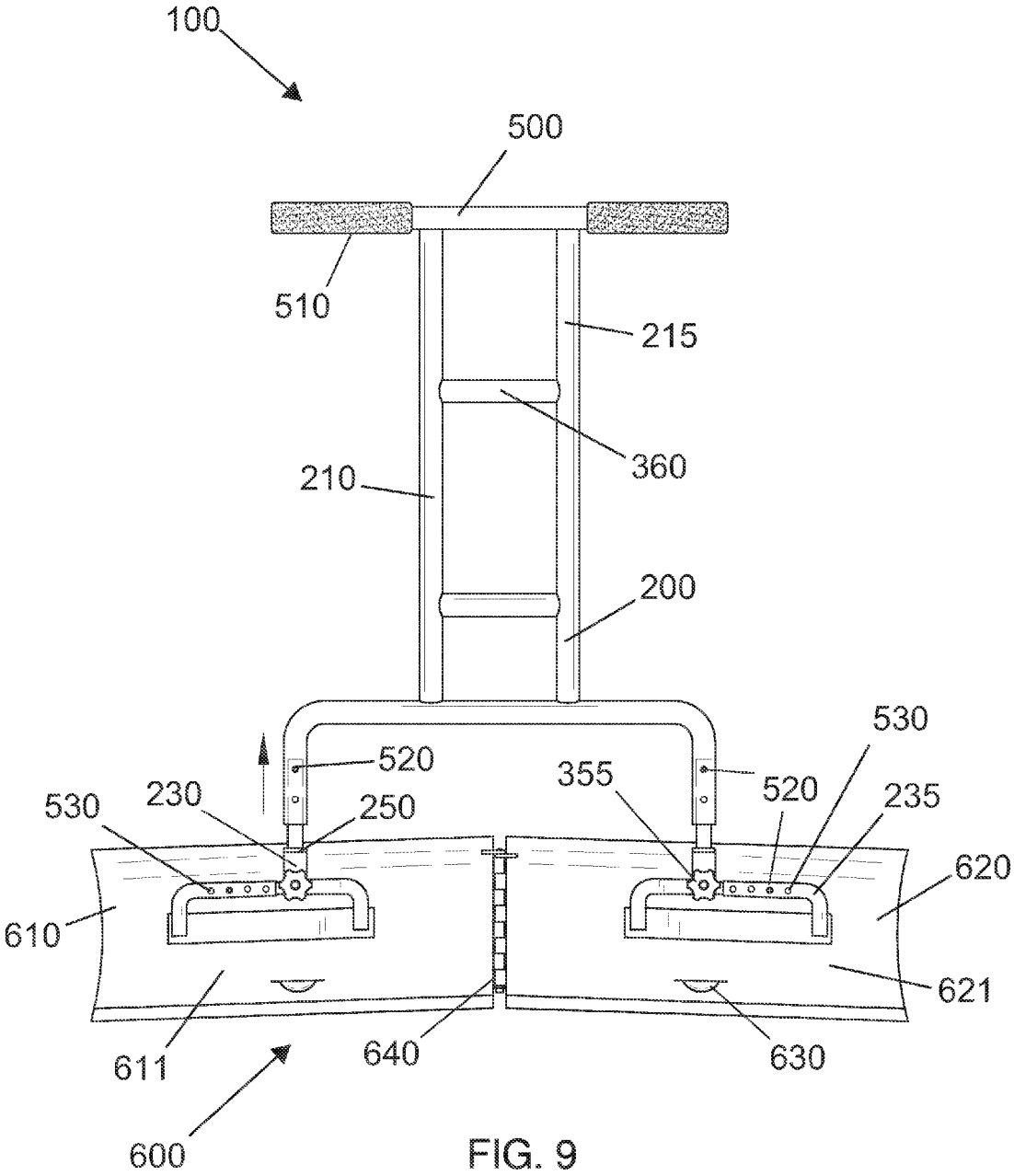
FIG. 9 is a rear view of an alternate embodiment of the present invention.

Following is a list of elements corresponding to a particular element referred to herein:

100 Snow shovel system
200 Shovel frame
210 Shovel frame first side
211 Shovel frame first side first end
212 Shovel frame first side second end
213 Shovel frame first side middle region
215 Shovel frame second side
216 Shovel frame second side first end
217 Shovel frame second side second end
218 Shovel frame second side middle region
220 Shovel first side handlebar mount
221 Shovel first side handlebar mount first end
225 Shovel second side handlebar mount
226 Shovel second side handlebar mount first end
230 Shovel first side shovel mount
235 Shovel second side shovel mount
250 Rotating bearing
300 First positioning member
310 Second positioning member
320 Third positioning member
330 Fourth positioning member
340 Fifth positioning member
350 Sixth positioning member
355 Positioning member
360 Cross member
400 Plane A
410 Plane B
420 Plane C
500 Handlebar
501 Handlebar first end
502 Handlebar second end
510 Grip component
520 Spring loaded pin
530 Pin aperture
600 Shovel assembly
610 First shovel member
611 First shovel member back surface
620 Second shovel member
621 Second shovel member back surface
630 Shovel bumper
640 Hinge
642 Hingepin
644 Hinge aperture
650 Shovel assembly first width
660 Shovel assembly second width
700 Indexing surface
710 Aperture
800 V support Referring now to FIG. 1-9, the present invention features an adjustable snow shovel system (100) for facilitating effective removal of accumulated snow. In some embodiments, the system (100) comprises a generally tubular, three-way adjustable shovel frame (200) having a shovel frame first side (210), a shovel frame second side (215), an adjustable shovel first side handlebar mount (220) disposed on a shovel frame first side first end (211), an adjustable shovel second side handlebar mount (225) disposed on a shovel frame second side first end (216), a swivelling shovel first side shovel mount (230) disposed on a shovel frame first side second end (212), and a swivelling shovel second side shovel mount (235) disposed on a shovel frame second side second end (217).

In some embodiments, the first side handlebar mount (220) is slid over the shovel frame first side first end (211) and held into place via a spring loaded pin (520) inserted through a pin aperture (530). In some embodiments, the second side handlebar mount (225) is slid over the shovel frame second side first end (216) and held into place via a spring loaded pin (520) inserted through a pin aperture (530).

In some embodiments, the system comprises a first positioning member (300) pivotally disposed generally in a shovel frame first side middle region (213), a second positioning member (310) pivotally disposed generally in a shovel frame second side middle region (218), a third positioning member (320) disposed on a shovel first side handlebar mount first end (221), a fourth positioning member (330) disposed on a shovel second side handlebar mount first end (226), a fifth positioning member (340) disposed on the shovel frame first side (210) proximal to the shovel first side shovel mount (230), and a sixth positioning member (350) disposed on the shovel frame second side (215) proximal to the shovel second side shovel mount (235). In some embodiments, the first positioning member (300), the second positioning member (310), the third positioning member (320), the fourth positioning member (330), the fifth positioning member (340), and the sixth positioning member (350) each comprise a first indexing surface (700) with a centrally disposed aperture (710), a second indexing surface (700) with a centrally disposed aperture (710), and a bolt, wherein the first indexing, surface (700) interfaces with the second indexing surface (700) and a bolt is disposed through the aligned apertures (710), wherein the bolt is for applying a clamping force thereon.

In some embodiments, the shovel frame first side (210) and the shovel frame second side (215) are attached by a plurality of tubular horizontal cross members (360) disposed thereon. In some embodiments, in a fully upright position, the shovel frame (200) is adjustable in a plane, Plane A (400). In some embodiments, Plane A (400) is perpendicular to a generally horizontal ground surface. In some embodiments, the shovel frame (200) can be affixed into position between 0 and 90 degrees in Plane A (400) with respect to the generally horizontal ground surface via the first positioning member (300) and the second positioning member (310). In some embodiments, the shovel frame (200) is adjustable for facilitating effective removal of accumulated snow by changing the angle of the shovel frame (200).

In some embodiments, the system (100) comprises a generally tubular, adjustable handlebar (500) having a handlebar first end (501) and a handlebar second end (502). In some embodiments, the handlebar (500) is generally horizontally disposed on the shovel frame (200) via the shovel first side handlebar mount (220) and the shovel second side handlebar mount (225). In some embodiments, in a fully upright position, the handlebar (500) is adjustable in a plane, Plane B (410). In some embodiments, Plane B (410) is perpendicular to Plane A (400). In some embodiments, Plane B (410) is perpendicular to a generally horizontal ground surface. In some embodiments, the handlebar (500) can be affixed into position between 0 and 90 degrees in Plane B (410) with respect to the generally horizontal ground surface via the third positioning member (320) and the fourth positioning member (330). In some embodiments, the handlebar (500) is adjustable for facilitating effective removal of accumulated snow by changing the angle of the handlebar (500)

In some embodiments, the system comprises a pivotally adjustable shovel assembly (600) having a first shovel member (610) and a second shovel member (620). In some embodiments, the first shovel member (610) is pivotally disposed on the second shovel member (620). In some embodiments, the shovel assembly (600) is generally horizontally disposed on and in-line with the shovel frame (200) via the swivelling shovel first side shovel mount (230) and a swivelling shovel second side shovel mount (235).

In some embodiments, in a fully upright position, the shovel assembly (600) is adjustable in a plane, Plane C (420). In some embodiments, Plane C (420) is perpendicular to both Plane A (400) and Plane B (410). In some embodiments, the shovel assembly (600) can be affixed into position between 0 and 90 degrees in Plane C (420) via the fifth positioning member (340) and the sixth positioning member (350). In some embodiments, Plane C is generally parallel to the generally horizontal ground surface.

In some embodiments, the shovel assembly (600) can be affixed into a position having the first shovel member (610) and the second shovel member (620) in-line with one another in a shovel assembly comprising a first width (650) for facilitating effective removal of accumulated snow. In some embodiments, the shovel assembly (600) can be affixed into a position having the first shovel member (610) and the second shovel member (620) disposed at an angle with respect to one another in a shovel assembly comprising a second width (660) for facilitating effective removal of accumulated snow. In some embodiments, the shovel assembly can be affixed into any position between the first width (650) and the second width (660).

In some embodiments the first width (650) and the second width (660) are measured from a first shovel member (610) first edge to a second shovel member (620) second edge. In some embodiments, the first width (650) is about 48 inches. In some embodiments, the first width (650) is between about 48 inches and about 60 inches. In some embodiments, the first width (650) is between about 60 inches and about 72 inches. In some embodiments, the first width (650) is between about 36 inches and about 48 inches. In some embodiments, the first width (650) is between about 24 inches and about 36 inches. In some embodiments, the second width (660) is about 48 inches. In some embodiments, the second width (660) is between about 48 inches and about 60 inches. In some embodiments, the second width (660) is between about 60 inches and about 72 inches. In some embodiments, the second width (660) is between about 36 inches and about 48 inches. In some embodiments, the second width (660) is between about 24 inches and about 36 inches.

In some embodiments, the handlebar first end (501) comprises a grip component disposed thereon. In some embodiments, the handlebar second end (502) comprises a grip component (510) disposed thereon. In some embodiments, the grip component (510) is rubber. In some embodiments, the grip component (510) is heated.

In some embodiments, a first shovel bumper (630) is disposed on a first shovel member back surface (611) and a second shovel bumper (630) is disposed on a second shovel member back surface (621). In some embodiments, the first shovel member (610) is pivotally disposed on the second shovel member (620) via a generally vertical hinge (640) having a hinge pin (642) located through hinge apertures (644) located on an edge of a first shovel member (610) and an edge of a second shovel member (620). In some embodiments, the swivelling shovel first side shovel mount (230), and the swivelling shovel second side shovel mount (235) comprise a rotating bearing (250). In some embodiments, a first shovel wheel is disposed on a first shovel member back surface (611) and a second shovel wheel is disposed on a second shovel member back surface (621). In some embodiments, the first shovel wheel and the second shovel wheel are for ease of transport of the system (100).

In some embodiments, a V support (800) is pivotally disposed between a shovel first side shovel mount (230) and a shovel second side shovel mount (235). In some embodiments, the V support (800) comprises an adjustable length. In some embodiments, the V support (800) is telescopically adjustable and held into position via a spring loaded pin (520) and a pin aperture (530).

In some embodiments, a snow shovel system (100) is for facilitating effective removal of accumulated snow. In some embodiments, the system (100) comprises a generally tubular, shovel frame (200) having a shovel frame first side (210), a shovel frame second side (215) and a swivelling shovel first side shovel mount (230) located on a shovel frame first side second end (212).

In some embodiments, the swivelling shovel first side mount can be affixed into position at a desired position (angle) via a positioning member (355). In some embodiments, the height of the shovel is adjustable via the spring loaded pin (520) disposed through one of a plurality of pin apertures (530) disposed on the shovel frame (200) proximal to the shovel frame first side second end (212). In some embodiments, the position (angle) of the swivelling shovel first side shovel mount (230) is adjustable via the spring loaded pin (520) disposed through one of a plurality of pin apertures (530) disposed thereon. In some embodiments, a swivelling shovel second side shovel mount (235) is located on a shovel frame second side second end (217). In some embodiments, the swivelling shovel second side mount (235) can be affixed into position at a desired position (angle) via a positioning member (355). In some embodiments, the height of the shovel is adjustable via the spring loaded pin (520) disposed through one of a plurality of pin apertures (530) disposed on the shovel frame (200) proximal to the shovel frame second side second end (217). In some embodiments, the position (angle) of the swivelling shovel second side shovel mount (235) is adjustable via the spring loaded pin (520) disposed through one of a plurality of pin apertures (530) disposed thereon. In some embodiments, the shovel frame first side (210) and the shovel frame second side (215) are attached by a plurality of tubular horizontal cross members (360) located thereon.

In some embodiments, the system comprises a generally tubular handlebar (500) having a handlebar first end (501) and a handlebar second end (502). In some embodiments, the handlebar (500) is generally horizontally located on the shovel frame (200).

In some embodiments, the system (100) comprises a pivotally adjustable shovel assembly (600) having a first shovel member (610) and a second shovel member (620). In some embodiments, the first shovel member (610) is pivotally located on the second shovel member (620). In some embodiments, the shovel assembly (600) is generally horizontally located on the shovel frame (200) via the swivelling shovel first side shovel mount (230) and the swivelling shovel second side shovel mount (235). In some embodiments, in a fully upright position, the shovel assembly (600) is adjustable in a plane, Plane C (420). In some embodiments, the shovel assembly (600) can be affixed into position between 0 and 90 degrees in Plane C (420). In some embodiments, Plane C (420) is generally parallel to the generally horizontal ground surface. In some embodiments, the shovel assembly (600) can be affixed into a position having the first shovel member (610) and the second shovel member (620) in-line with one another in a shovel assembly first width (650) for facilitating effective removal of accumulated snow. In some embodiments, the shovel assembly (600) can be affixed into a position having the first shovel member (610) and the second shovel member (620) located at an angle with respect to one another in a shovel assembly second width (660) for facilitating effective removal of accumulated snow. In some embodiments, the shovel assembly (600) can be affixed into position via the spring loaded pin (520) disposed through one of a plurality of pin apertures (530) disposed on the swivelling shovel first side shovel mount (230) and the swivelling shovel second side shovel mount (235).

As used herein, the term "about" refers to plus or minus 10% of the referenced number. For example, an embodiment wherein the shovel assembly is about 10 inches in length includes a shovel assembly that is between 9 and 11 inches in length.

The disclosures of the following U.S. Patents are incorporated in their entirety by reference herein: U.S. Pat. Pub. No. 2011/0258888 A1; U.S. Pat. Pub. No. 2011/0214316 A1; U.S. Pat. Pub. No. 2005/0268498; U.S. Pat. Pub. No. 2002/0088148; U.S. Pat. No. 6,269,558; U.S. Pat. No. 5,791,072; U.S. Pat. No. 5,727,830; U.S. Pat. No. 2,388,985.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An adjustable snow shovel system (100) for facilitating effective removal of accumulated snow, wherein said system (100) comprises:

(a) a generally tubular, three-way adjustable shovel frame (200) having a shovel frame first side (210), a shovel frame second side (215), an adjustable shovel first side handlebar mount (220) disposed on a shovel frame first side first end (211), an adjustable shovel second side handlebar mount (225) disposed on a shovel frame second side first end (216), a swivelling shovel first side shovel mount (230) disposed on a shovel frame first side second end (212), a swivelling shovel second side shovel mount (235) disposed on a shovel frame second side second end (217), a first positioning member (300) pivotally disposed generally in a shovel frame first side middle region (213), a second positioning member (310) pivotally disposed generally in a shovel frame second side middle region (218), a third positioning member (320) disposed on a shovel first side handlebar mount first end (221), a fourth positioning member (330) disposed on a shovel second side handlebar mount first end (226), a fifth positioning member (340) disposed on the shovel frame first side (210) proximal to the shovel first side shovel mount (230), a sixth positioning member (350) disposed on the shovel frame second side (215) proximal to the shovel second side shovel mount (235), wherein the shovel frame first side (210) and the shovel frame second side (215) are attached by a plurality of tubular horizontal cross members (360) disposed thereon, wherein in a fully upright position, the shovel frame (200) is adjustable in a plane, Plane A (400), wherein Plane A (400) is perpendicular to a generally horizontal ground surface, wherein the shovel frame (200) can be affixed into position between 0 and 90 degrees in Plane A (400) with respect to the generally horizontal ground surface via the first positioning member (300) and the second positioning member (310);

(b) a generally tubular, adjustable handlebar (500) having a handlebar first end (501) and a handlebar second end (502), wherein the handlebar (500) is generally horizontally disposed on the shovel frame (200) via the shovel first side handlebar mount (220) and the shovel second side handlebar mount (225), wherein in a fully upright position, the handlebar (500) is adjustable in a plane, Plane B (410), wherein Plane B (410) is perpendicular to Plane A (400), wherein Plane B (410) is perpendicular to a generally horizontal ground surface, wherein the handlebar can be affixed into position between 0 and 90 degrees in Plane B (410) with respect to the generally horizontal ground surface via the third positioning member (320) and the fourth positioning member (330), wherein the handlebar (500) is adjustable for facilitating effective removal of accumulated snow; and (c) a pivotally adjustable shovel assembly (600) having a first shovel member (610) and a second shovel member (620), wherein the first shovel member (610) is pivotally disposed on the second shovel member (620) via a hinge (640), wherein the shovel assembly (600) is generally horizontally disposed on the shovel frame (200) via the swivelling shovel first side shovel mount (230), and the swivelling shovel second side shovel mount (235), wherein in a fully upright position, the shovel assembly (600) is adjustable in a plane, Plane C (420), wherein Plane C (420) is perpendicular to Plane A (400) and Plane B (410), wherein the shovel assembly (600) can be affixed into position between 0 and 90 degrees in Plane C (420) via the fifth positioning member (340) and the sixth positioning member (350), wherein Plane C (420) is generally parallel to the generally horizontal ground surface, wherein the shovel assembly (600) can be affixed into a position having the first shovel member (610) and the second shovel member (620) in-line with one another in a shovel assembly first width (650) for facilitating effective removal of accumulated snow, wherein the shovel assembly (600) can be affixed into a position having the first shovel member (610) and the second shovel member (620) disposed at an angle with respect to one another in a shovel assembly second width (660) for facilitating effective removal of accumulated snow.

2. The system (100) of claim 1, wherein the handlebar first end (501) comprises a first grip component (510) disposed thereon, wherein the handlebar second end (502) comprises a second grip component (510) disposed thereon.

3. The system (100) of claim 1, wherein a first shovel bumper (630) is disposed on a first shovel member back surface (611) and a second shovel bumper (630) is disposed on a second shovel member back surface (621).

4. The system (100) of claim 1, wherein the swivelling shovel first side shovel mount (230) and the swivelling shovel second side shovel mount (235) comprise a rotating bearing (250).

5. An adjustable snow shovel system (100) for facilitating effective removal of accumulated snow, wherein said system (100) consists of:

(a) a generally tubular, three-way adjustable shovel frame (200) having a shovel frame first side (210), a shovel frame second side (215), an adjustable shovel first side handlebar mount (220) disposed on a shovel frame first side first end (211), an adjustable shovel second side handlebar mount (225) disposed on a shovel frame second side first end (216), a swivelling shovel first side shovel mount (230) disposed on a shovel frame first side second end (212), a swivelling shovel second side shovel mount (235) disposed on a shovel frame second side second end (217), a first positioning member (300) pivotally disposed generally in a shovel frame first side middle region (213), a second positioning member (310) pivotally disposed generally in a shovel frame second side middle region (218), a third positioning member (320) disposed on a shovel first side handlebar mount first end (221), a fourth positioning member (330) disposed on a shovel second side handlebar mount first end (226), a fifth positioning member (340) disposed on the shovel frame first side (210) proximal to the shovel first side shovel mount (230), a sixth positioning member (350) disposed on the shovel frame second side (215) proximal to the shovel second side shovel mount (235), wherein the shovel frame first side (210) and the shovel frame second side (215) are attached by a plurality of tubular horizontal cross members (360) disposed thereon, wherein in a fully upright position, the shovel frame (200) is adjustable in a plane, Plane A (400), wherein Plane A (400) is perpendicular to a generally horizontal ground surface, wherein the shovel frame (200) can be affixed into position between 0 and 90 degrees in Plane A (400) with respect to the generally horizontal ground surface via the first positioning member (300) and the second positioning member (310);

(b) a generally tubular, adjustable handlebar (500) having a handlebar first end (501) and a handlebar second end (502), wherein the handlebar (500) is generally horizontally disposed on the shovel frame (200) via the shovel first side handlebar mount (220) and the shovel second side handlebar mount (225), wherein in a fully upright position, the handlebar (500) is adjustable in a plane, Plane B (410), wherein Plane B (410) is perpendicular to Plane A (400), wherein Plane B (410) is perpendicular to a generally horizontal ground surface, wherein the handlebar can be affixed into position between 0 and 90 degrees in Plane B (410) with respect to the generally horizontal ground surface via the third positioning member (320) and the fourth positioning member (330), wherein the handlebar (500) is adjustable for facilitating effective removal of accumulated snow; and (c) a pivotally adjustable shovel assembly (600) having a first shovel member (610) and a second shovel member (620), wherein the first shovel member (610) is pivotally disposed on the second shovel member (620) via a hinge (640), wherein the shovel assembly (600) is generally horizontally disposed on the shovel frame (200) via the swivelling shovel first side shovel mount (230), and the swivelling shovel second side shovel mount (235), wherein in a fully upright position, the shovel assembly (600) is adjustable in a plane, Plane C (420), wherein Plane C (420) is perpendicular to Plane A (400) and Plane B (410), wherein the shovel assembly (600) can be affixed into position between 0 and 90 degrees in Plane C (420) via the fifth positioning member (340) and the sixth positioning member (350), wherein Plane C (420) is generally parallel to the generally horizontal ground surface, wherein the shovel assembly (600) can be affixed into a position having the first shovel member (610) and the second shovel member (620) in-line with one another in a shovel assembly first width (650) for facilitating effective removal of accumulated snow, wherein the shovel assembly (600) can be affixed into a position having the first shovel member (610) and the second shovel member (620) disposed at an angle with respect to one another in a shovel assembly second width (660) for facilitating effective removal of accumulated snow.

* * * * *